US009834906B1

(12) United States Patent
Linares et al.

(10) Patent No.: US 9,834,906 B1
(45) Date of Patent: Dec. 5, 2017

(54) BEACH UMBRELLA WITH BUILT-IN HOLE DIGGER

(71) Applicants: Ricardo German Linares, Bedford, NH (US); Silvia Linares, Bedford, NH (US)

(72) Inventors: Ricardo German Linares, Bedford, NH (US); Silvia Linares, Bedford, NH (US)

( * ) Notice: Subject to any disclaimer, the term of this patent is extended or adjusted under 35 U.S.C. 154(b) by 0 days.

(21) Appl. No.: 15/592,594

(22) Filed: May 11, 2017

(51) Int. Cl.

| | |
|---|---|
| ***A45B 3/00*** | (2006.01) |
| ***E02F 3/88*** | (2006.01) |
| ***A45B 23/00*** | (2006.01) |
| ***E02F 1/00*** | (2006.01) |
| ***E02F 3/92*** | (2006.01) |
| ***E02F 5/18*** | (2006.01) |

(52) U.S. Cl.
CPC ..... *E02F 3/8891* (2013.01); *A45B 3/00* (2013.01); *A45B 23/00* (2013.01); *E02F 1/00* (2013.01); *E02F 3/9243* (2013.01); *E02F 5/18* (2013.01); *A45B 2023/0012* (2013.01); *A45B 2200/1009* (2013.01); *A45B 2200/109* (2013.01)

(58) Field of Classification Search
CPC ..... A45B 2023/0012; A45B 3/00; A45B 2200/1009; E02F 1/00; E02F 3/8891; E02F 3/9243; E02F 5/18; B25D 1/16
USPC ..... 135/16, 98, 99, 118, 902; 405/232, 244, 405/245; 173/90–91
See application file for complete search history.

(56) References Cited

U.S. PATENT DOCUMENTS

| | | | | |
|---|---|---|---|---|
| 5,088,681 | A | 2/1992 | Procaccianti et al. | |
| 5,152,495 | A * | 10/1992 | Jacinto | E04H 12/2223 135/98 |
| 5,156,369 | A * | 10/1992 | Tizzoni | E04H 12/2223 135/16 |
| 5,396,916 | A * | 3/1995 | Boissonnault | A45B 7/005 135/16 |
| 5,457,918 | A * | 10/1995 | Plourde | E04H 12/2223 248/545 |
| 5,535,978 | A | 7/1996 | Rodriguez et al. | |
| 6,899,187 | B1 * | 5/2005 | McCarthy | B25D 1/16 135/99 |
| 6,908,067 | B2 * | 6/2005 | Clasen | E04H 12/2223 248/533 |
| 7,950,200 | B2 * | 5/2011 | Tropiano | E04H 12/2223 135/98 |
| 8,276,683 | B1 * | 10/2012 | Roy | B25D 1/16 173/126 |
| 9,179,745 | B2 | 11/2015 | Berland | |
| 2006/0032522 | A1 | 2/2006 | Brooks, III | |
| 2006/0241647 | A1 * | 10/2006 | Chen | B25D 1/00 606/100 |

(Continued)

*Primary Examiner* — Winnie Yip
(74) *Attorney, Agent, or Firm* — Dunlap Bennett & Ludwig PLLC

(57) ABSTRACT

A beach umbrella with a built-in sand hole digging apparatus. The digging apparatus includes a tube and a piston. The tube includes an interior sidewall forming a hollow core. The tube further includes a top end forming a top opening and a bottom end forming a bottom opening. The piston includes an elongated rod. The elongated rod includes a top end protruding from the top opening of the tube. A head is attached to the bottom end of the piston. The head is disposed within the hollow core of the tube and is slidably engaged with the sidewall.

10 Claims, 8 Drawing Sheets

(56) References Cited

U.S. PATENT DOCUMENTS

2008/0099061 A1 5/2008 McKnight
2011/0253876 A1* 10/2011 Odell ..... E04H 12/2215
248/530

* cited by examiner

BEACH UMBRELLA WITH BUILT-IN HOLE DIGGER

BACKGROUND OF THE INVENTION

The present invention relates to beach umbrellas and, more particularly, to a special kind of beach umbrella with an incorporated sand hole digging apparatus.

A beach umbrella is an umbrella used at the beach to protect a user from the sun. To setup a beach umbrella, a hole needs to be dug in the sand. The shaft of the umbrella is then placed in the hole, and sand fills the remaining space in the hole. Digging the hole requires additional tools, such as shovels, a corkscrew mechanism and the like. Therefore, additional equipment must be carried to the beach to setup the beach umbrella.

As can be seen, there is a need for a digging apparatus that is integrated to the beach umbrella so that there is no need to carry a separate appliance to perform the hole digging.

SUMMARY OF THE INVENTION

In one aspect of the present invention, a digging apparatus comprises: a tube comprising an interior sidewall forming a hollow core, a top end comprising a top opening, and a bottom end comprising bottom opening; a piston disposed within the hollow core of the tube and comprising an elongated rod having a top end protruding from the top opening and a bottom end comprising a head slidably engaged with the interior sidewall, wherein when the top end of the of the piston is pulled, the head slides along the interior sidewall and a low pressure is formed within the hollow core; and an umbrella comprising an elongated pole having a top end and a bottom end, wherein a folding frame and a canopy are attached to the top end and the bottom end is releasably attachable to the top end of the tube.

In another aspect of the present invention, a method of setting up an umbrella comprises the steps of: providing a digging apparatus comprising: a tube comprising an interior sidewall forming a hollow core, a top end comprising a top opening, and a bottom end comprising bottom opening; and a piston disposed within the hollow core of the tube and comprising an elongated rod having a top end protruding from the top opening and a bottom end comprising a head slidably engaged with the interior sidewall; placing the bottom end of the digging apparatus against sand; pulling the top end of the piston upwards, thereby creating a low pressure within the hollow core and pulling the sand into the hollow core, wherein a hole is formed in the sand; pushing the top end of the piston inwards and thereby dumping the sand from the hollow core outside of the hole; placing the digging apparatus into the hole; and attaching the umbrella to the top end of the tube.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 2:
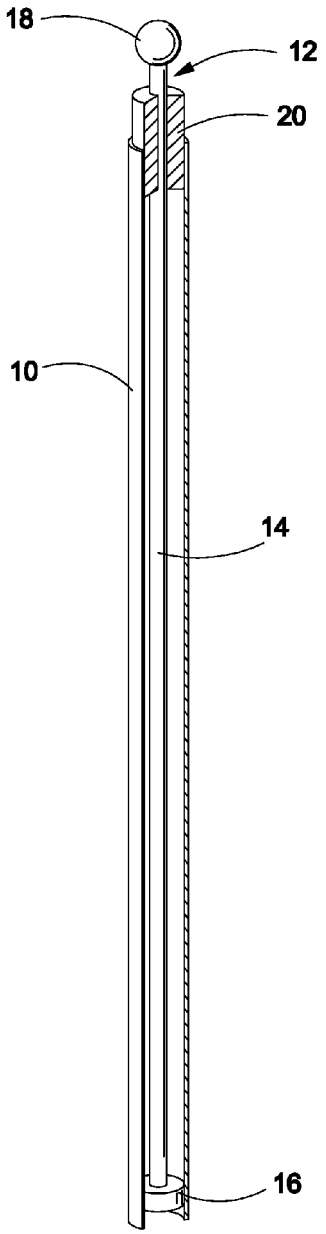
FIG. 2 is a cross sectional view of the present invention taken along line 2-2 in FIG. 1.
Figure 1:
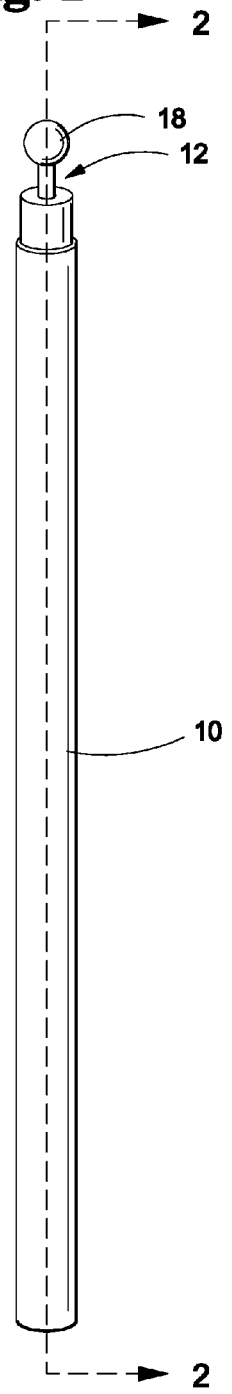
FIG. 1 is a perspective view of an embodiment of the present invention.
Figure 3:
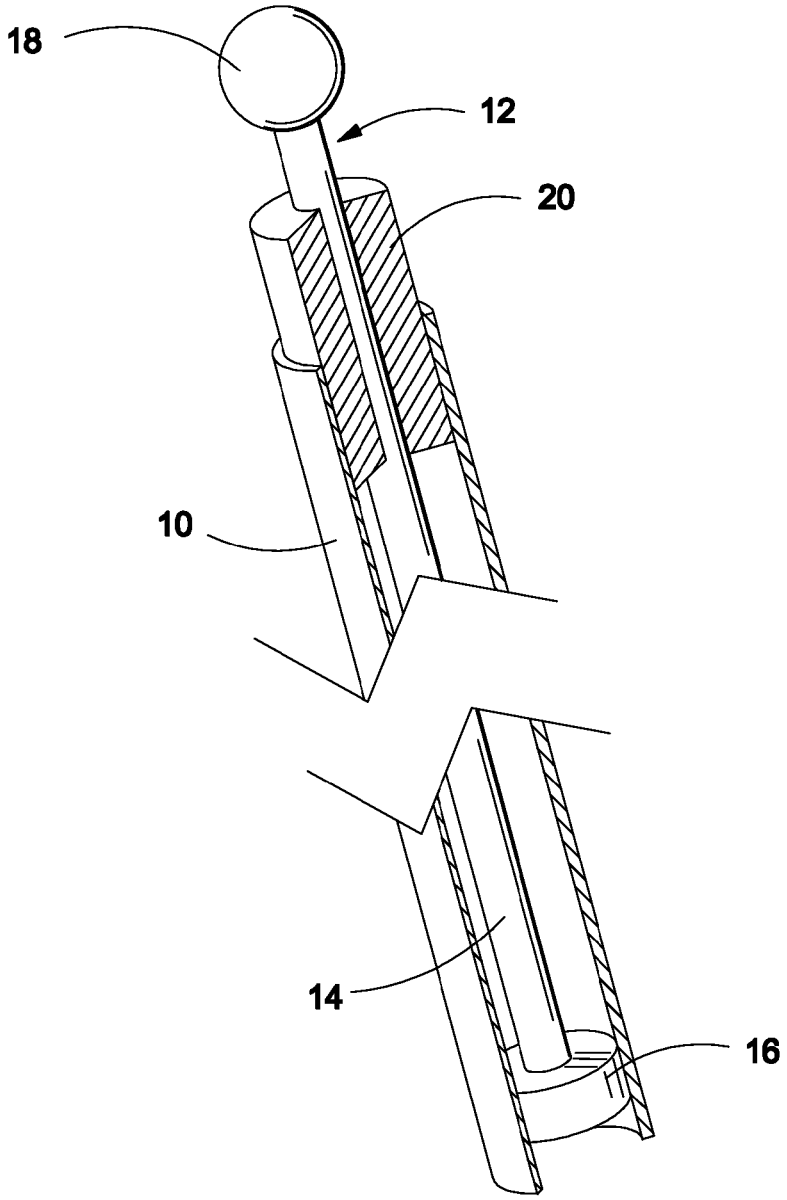
FIG. 3 is a section detail cross sectional view of an embodiment of the present invention.
Figure 5:
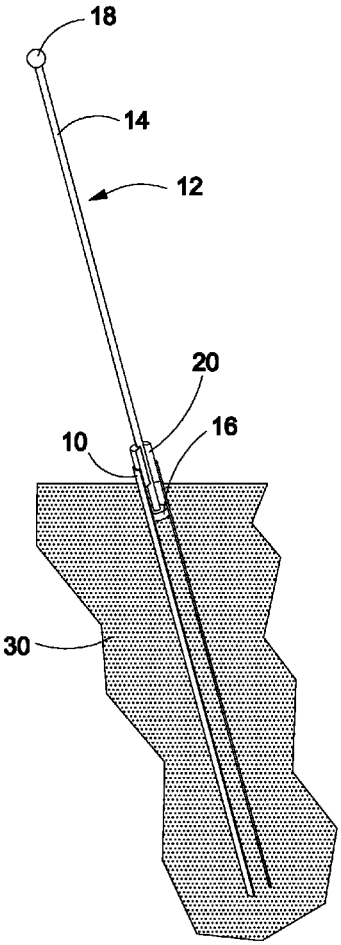
FIG. 5 is a cross sectional perspective view of an embodiment of the present invention in use.
Figure 4:
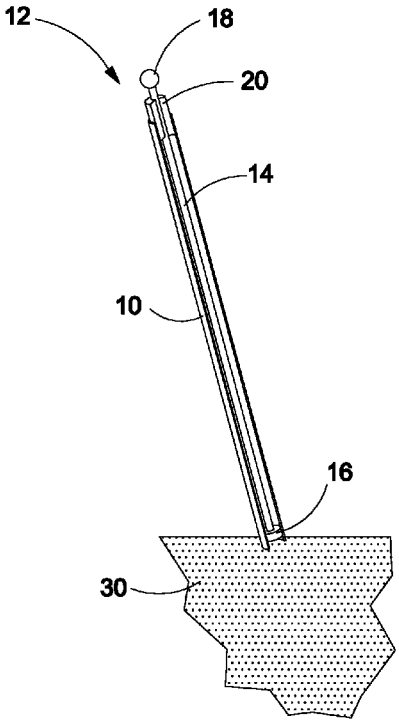
FIG. 4 is a cross sectional perspective view of an embodiment of the present invention in use.
Figure 6:
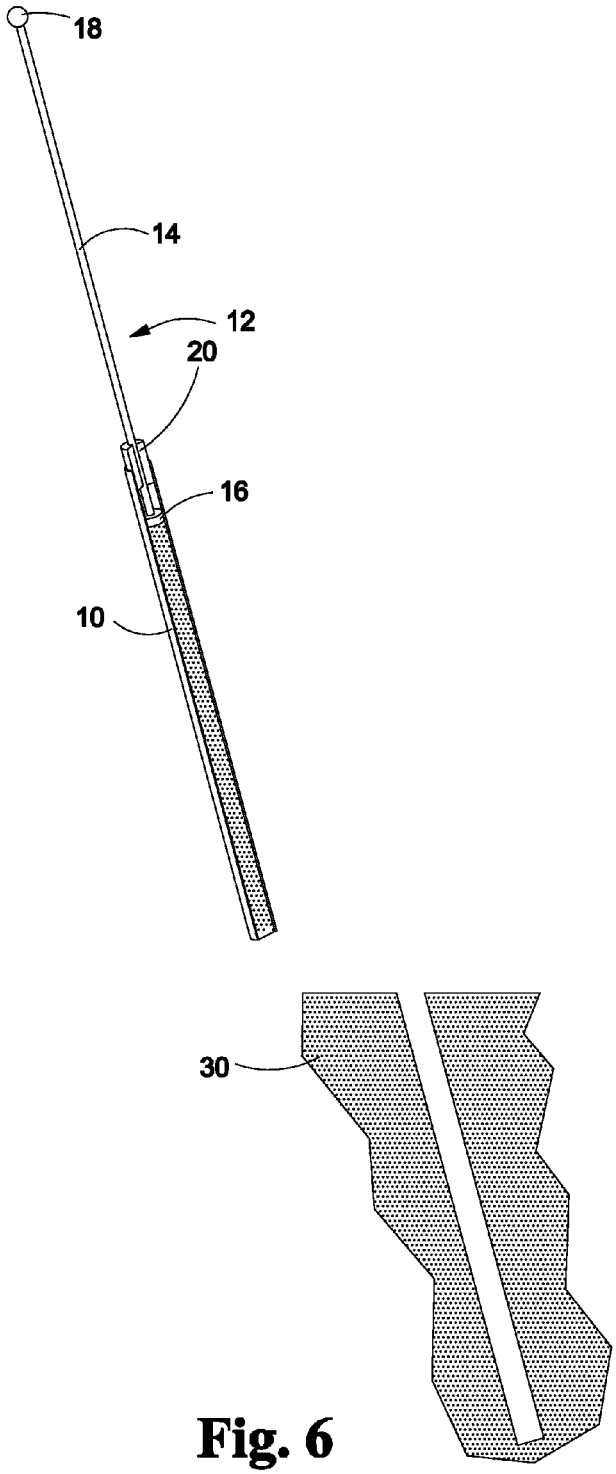
FIG. 6 is a cross sectional perspective view of an embodiment of the present invention in use.
Figure 7:
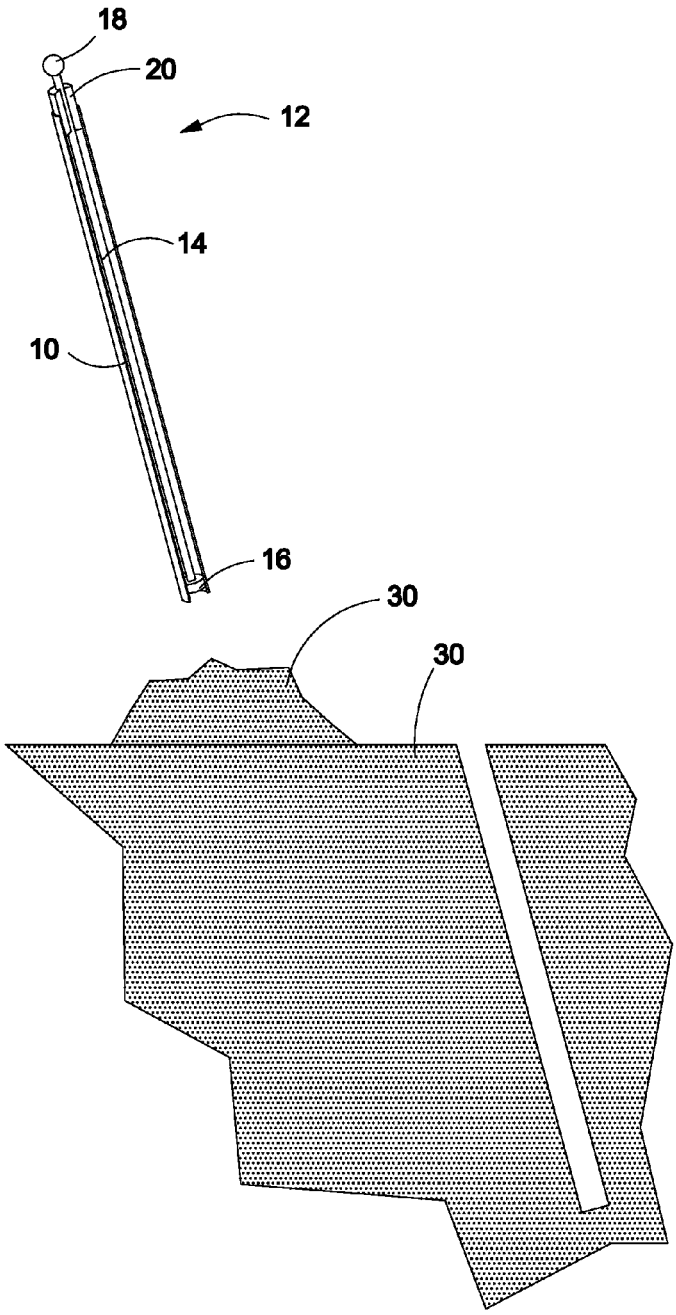
FIG. 7 is a cross sectional perspective view of an embodiment of the present invention in use.
Figure 8:
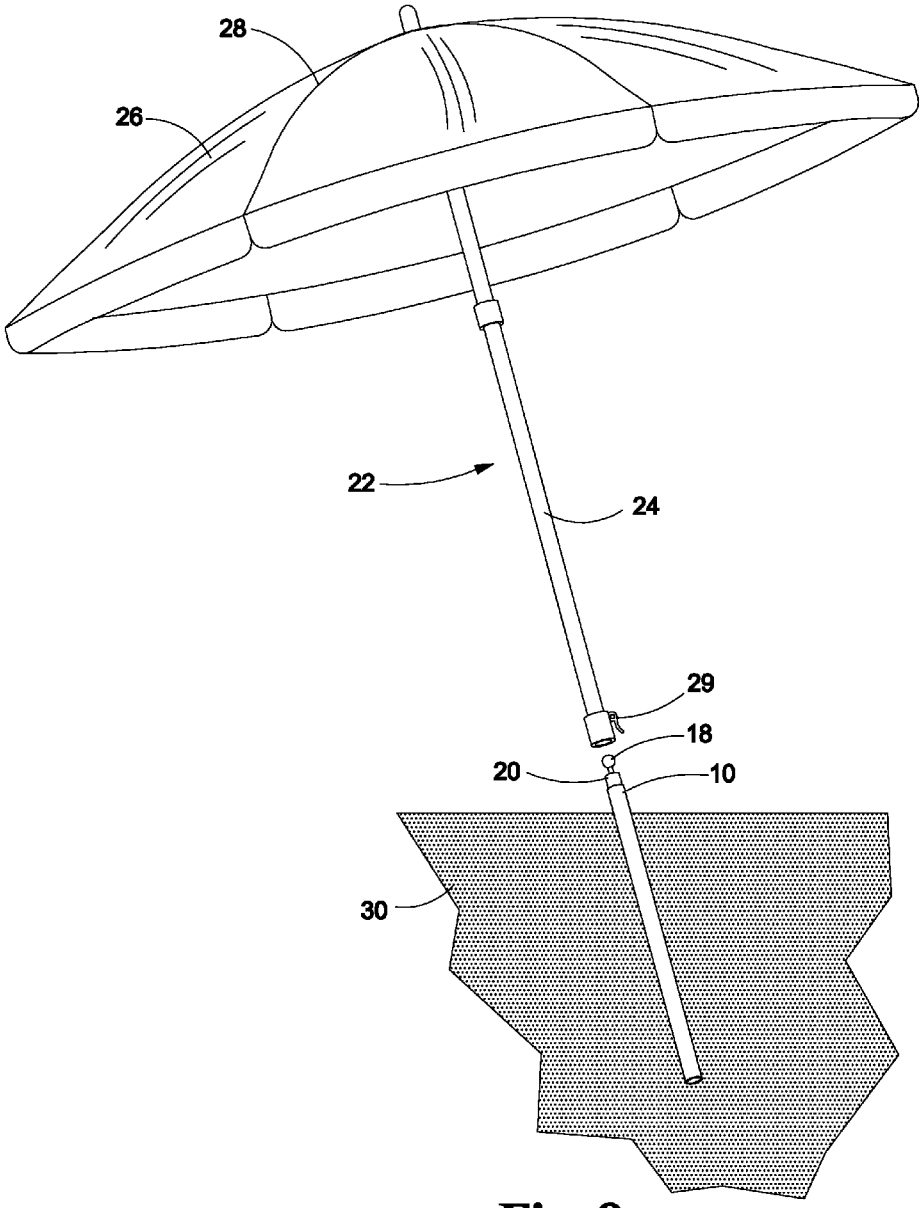
FIG. 8 is a perspective view of an embodiment of the present invention in use.
Figure 9:
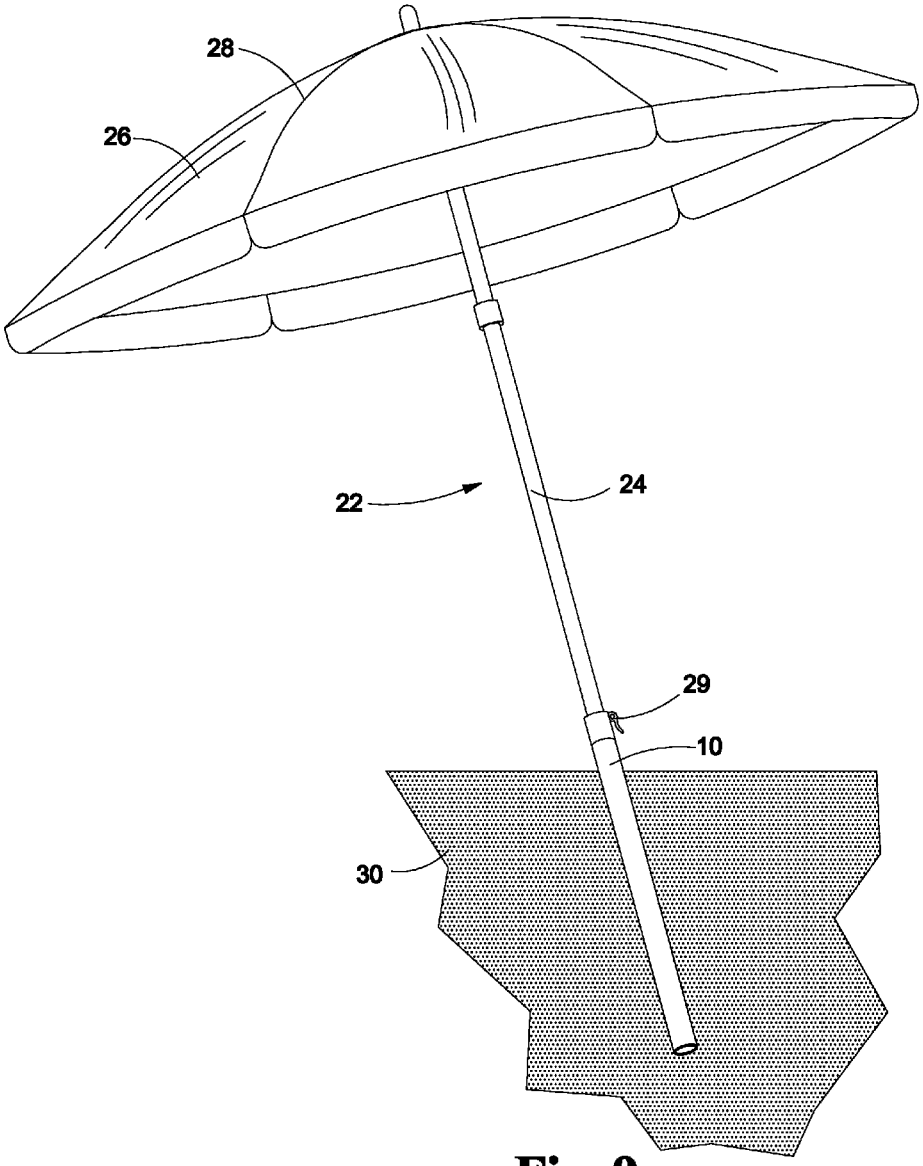
FIG. 9 is a perspective view of an embodiment of the present invention in use.
Figure 10:
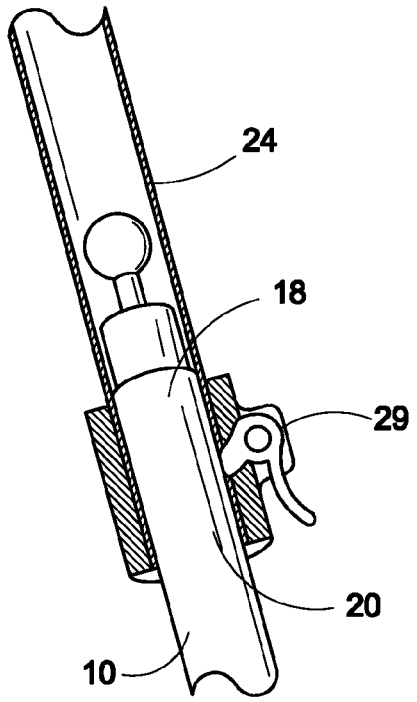
FIG. 10 is section detail cross sectional view of an embodiment of the present invention.
Figure 11:
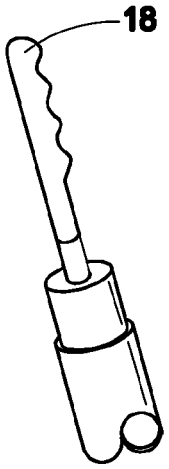
FIG. 11 is a section detail view of an embodiment of the present invention.

Referring to FIGS. 1 through 11, the present invention includes a digging apparatus (the bottom pole of the umbrella). The digging apparatus includes a tube 10 and a piston 12. The tube 10 and piston 12 may be made of brass, steel, polymers such as PVC piping, iron, nickel alloy and other materials. The tube 10 may include a cylindrical shape having an interior sidewall forming a hollow core. The tube 10 further includes a top end forming a top opening and a bottom end forming a bottom opening. The piston 12 includes an elongated rod 14. The elongated rod 14 includes a top end protruding from the top opening of the tube 10. A head 16 is attached to the bottom end of the piston 12. The head 16 is disposed within the hollow core of the tube 10 and is slidably engaged with the sidewall.

The digging apparatus may further include a guide for the piston 12. In such embodiments, the present invention may include a top cap 20. The top cap 20 is secured within the top opening of the top end of the tube 10. The top cap 20 may include a hollow core forming the guide for the elongated rod 14 of the piston 12. The elongated rod 14 slides within the guide.

The piston 12 of the present invention may include a handle 18. In certain embodiments, the handle 18 is secured to the top end of the elongated rod 14 of the piston 12. The handle 18 may be used to pull the piston 12 upwards out of the tube 10 and push the piston 12 downwards into the tube 10. The handle 18 may include a ball or alternatively, may include a cylinder with a plurality of finger groves.

The present invention further includes an umbrella 22. The umbrella 22 includes an elongated pole 24 having a top end and a bottom end. A folding frame 28 and a canopy 26 are attached to the top end of the elongated poll 24. The bottom end of the elongated poll 24 is releasably attachable to the top end of the tube 10. For example, the bottom end of the elongated pole 24 may fit over the top end of the tube 10. In certain embodiments, a latch 29 is pivotally secured to the bottom end of the elongated pole 24. The bottom end of the elongated pole 24 may be placed over the top end of the tube 10 and the latch 29 may be pivoted until the latch 29 engages the tube in a locked position. The locked position secures the umbrella 22 to the tube 10.

A method of setting up an umbrella 22 may include the following steps. Provide the digging apparatus (bottom pole) described above. Place the bottom end of the digging apparatus against sand 30. Pull the handle 18 of the piston upwards, which pulls the head 16 upwards within the hollow core of the tube 10 creating a low pressure within the hollow core. Sand 30 is thereby pushed into the hollow core, forming a hole in the sand 30. Move the bottom end of the tube 10 away from the hole. Push the handle 18 of the piston downwards. The head 16 pushes the sand 30 out of the hollow core and dumps the sand 30 onto the ground. The tube 10 of the digging apparatus is placed within the hole. The umbrella 22 is then attached to the top end of the tube 10. A user may then open the frame 28 and use the umbrella for shade.

It should be understood, of course, that the foregoing relates to exemplary embodiments of the invention and that modifications may be made without departing from the spirit and scope of the invention as set forth in the following claims.

What is claimed is:

1. An apparatus comprising:

a tube comprising an interior sidewall forming a hollow core, a top end comprising a top opening, and a bottom end comprising bottom opening;

a piston disposed within the hollow core of the tube and comprising an elongated rod having a top end protruding from the top opening and a bottom end comprising a head slidably engaged with the interior sidewall, wherein when the top end of the of the piston is pulled, the head slides along the interior sidewall and a low pressure is formed within the hollow core; and an umbrella comprising an elongated pole having a top end and a bottom end, wherein a folding frame and a canopy are attached to the top end and the bottom end is releasably attachable to the top end of the tube.

2. The apparatus of claim 1, wherein the top end of the elongated rod is a handle.

3. The apparatus of claim 2, wherein the handle is one of a ball and a cylinder with finger grooves.

4. The apparatus of claim 1, wherein the bottom end of the elongated pole fits over the top end of the tube.

5. The apparatus of claim 4, further comprising a latch pivotally secured to the bottom end of the elongated pole, wherein the latch engages the tube in a locked position.

6. The apparatus of claim 1, further comprising a top cap disposed within the top opening and comprising a hollow core forming a guide for the elongated rod.

7. A method of setting up an umbrella comprising the steps of:

providing a digging apparatus comprising:

a tube comprising an interior sidewall forming a hollow core, a top end comprising a top opening, and a bottom end comprising bottom opening; and a piston disposed within the hollow core of the tube and comprising an elongated rod having a top end protruding from the top opening and a bottom end comprising a head slidably engaged with the interior sidewall;

placing the bottom end of the digging apparatus against sand;

pulling the top end of the piston upwards, thereby creating a low pressure within the hollow core and pulling the sand into the hollow core, wherein a hole is formed in the sand;

pushing the top end of the piston downwards and thereby dumping the sand from the hollow core outside of the hole;

placing the digging apparatus into the hole; and attaching the umbrella to the top end of the tube.

8. The method of claim 7, wherein the top end of the elongated rod is a handle.

9. The method of claim 7, further comprising a latch pivotally secured to a bottom end of the umbrella.

10. The method of claim 9, wherein the step of attaching the umbrella to the top end of the tube comprises the steps of:

placing an elongated pole of the umbrella over the top end of the tube; and pivoting the latch until the latch engages the tube in a locked position.

* * * * *